US009449597B2

(12) United States Patent
Li

(10) Patent No.: US 9,449,597 B2
(45) Date of Patent: Sep. 20, 2016

(54) ULTRASOUND RECEIVING MODULE, METHOD AND SYSTEM

(75) Inventor: Chien-Ju Li, Chaozhou Township, Pingtung County (TW)

(73) Assignee: INDUSTRIAL TECHNOLOGY RESEARCH INSTITUTE, Chutung, Hsinchu (TW)

( * ) Notice: Subject to any disclaimer, the term of this patent is extended or adjusted under 35 U.S.C. 154(b) by 1063 days.

(21) Appl. No.: 13/439,509

(22) Filed: Apr. 4, 2012

(65) Prior Publication Data

US 2013/0107670 A1 May 2, 2013

(30) Foreign Application Priority Data

Oct. 27, 2011 (TW) ..... 100139195 A

(51) Int. Cl.
*G10K 11/00* (2006.01)
*G10K 11/26* (2006.01)

(52) U.S. Cl.
CPC ..... *G10K 11/26* (2013.01)

(58) Field of Classification Search
CPC ..... G10K 11/26
See application file for complete search history.

(56) References Cited

U.S. PATENT DOCUMENTS 5,345,436 A 9/1994 Lipschutz
5,469,851 A 11/1995 Lipschutz
5,573,001 A 11/1996 Petrofsky et al.
5,905,692 A 5/1999 Dolazza et al.
6,494,842 B2 12/2002 Bae
6,695,783 B2 2/2004 Henderson et al.
8,457,579 B2 * 6/2013 Mishali et al. ..... 455/207
2002/0082500 A1 * 6/2002 Henderson et al. ..... 600/443
2006/0173335 A1 8/2006 Shah et al.
2007/0239001 A1 * 10/2007 Mehi et al. ..... 600/437

FOREIGN PATENT DOCUMENTS

CN 1283273 2/2001
CN 101427928 5/2009

OTHER PUBLICATIONS

Nagpal, Beamforming for Antenna Arrays BEE2 vs DSP Processors, https://casper.berkeley.edu/papers/beamforming.pdf, May 11, 2007, pp. 1-9.*
M. Karaman et al., "VLSI Circuits for Adaptive Digital Beamfoming in Ultrasound Imaging", *IEEE Transactions on Medical Imaging*, vol. 12, No. 4, Dec. 1993, pp. 711-720.
B. G. Tomov et al., "A new architecture for a single-chip multichannel beamformer based on a standard FPGA" *2001 IEEE Ultrasonics Symposium*, 2001, vol. 2, pp. 1529-1533.
(Continued)

*Primary Examiner* — Luke Ratcliffe
*Assistant Examiner* — Hovhannes Baghdasaryan
(74) *Attorney, Agent, or Firm* — Muncy, Geissler, Olds & Lowe, P.C.

(57) ABSTRACT

An ultrasound receiving method is provided. N return-wave signals corresponding to N channels are respectively stored in N set of shift register arrays. Each set includes a delay filter unit and M shift registers. A delay controller is utilized to assign a set of coefficients to the delay filter unit to perform an interpolation operation on data of the M shift registers to obtain an output value. The delay controller is utilized to decide delay time of each channel according to a delay table, and accordingly to control a time multiplexer to switch and output the N output values in order. A multiplier is utilized to multiply the output value received from the time multiplexer by a weighted value corresponding to the channel to obtain a corrected value. An accumulator is utilized to accumulate the N corrected values to obtain an image value.

8 Claims, 3 Drawing Sheets

(56) References Cited

OTHER PUBLICATIONS

H. Ohlsson et al., "Implementation of a Digital Beamformer in an FPGA Using Distributed Arithmetic" *IEEE Nordic Signal Processing Symposium*, Norsig2000, Kolmården, Sweden, Jun. 13-15, 2000, pp. 295-298.

V. S. Gierenz et al., "A Low Power Digital Beamformer for Handheld Ultrasound Systems", *Proceedings of the 27th European Solid-State Circuits Conference*, 2001, ESSCIRC 2001, Sep. 18-20, 2001, pp. 261-264.

* cited by examiner

ULTRASOUND RECEIVING MODULE, METHOD AND SYSTEM

This application claims the benefit of Taiwan application Serial No. 100139195, filed Oct. 27, 2011, the subject matter of which is incorporated herein by reference.

BACKGROUND

1. Technical Field

The disclosure relates in general to an ultrasound receiving module, method and system.

2. Background

In general, an ultrasound beam former includes a transmitting end and a receiving end. The transmitting end mainly controls timing sequences of channels for beam focusing and beam deviations, and assigns different weighted values to the channels to raise image qualities. The receiving end performs a delay and sum (DAS) operation on received signals of the channels. Path lengths of the channels from the probe to the focus point are different, hence the DAS operation is to work with delay compensation so that the signals have the maximum constructive interferences. Consequently, the ultrasound beam former provides a main controller with a random combination of the signals to generate grayscale images or blood flow imaging.

Now some commercial ultrasound imaging devices have different numbers of the channels of the probe because of the specifications and applications, so that compatibility and expandability issues need to be further considered. Some devices further need one set of post-stage processing units for the signals of each channel to perform follow-up rendering operations.

SUMMARY

The disclosure is directed to an ultrasound receiving module, method and system.

According to a first aspect of the present disclosure, an ultrasound receiving module is provided. The ultrasound receiving module includes N sets of shift register arrays, a delay controller, N FIFO buffers, a time multiplexer, a multiplier and an accumulator, N being a positive integer. The N sets of the shift register arrays respectively store N return-wave signals corresponding to N channels. Each set of the shift register arrays includes a delay filter unit and M shift registers, and the M shift registers are cascaded and store the corresponding return-wave signal, M being a positive integer. The delay controller decides delay time of each channel according to a delay table, and assigns a set of coefficients to the delay filter unit to perform an interpolation operation on data of the M shift registers to obtain an output value. The N FIFO buffers are respectively coupled to the N sets of the shift register arrays and temporarily store the N output values. The time multiplexer switches and outputs the N output values in order according to the delay time of each channel. The multiplier multiplies the output value received form the time multiplexer by a weighted value corresponding to the channel to obtain a corrected value. The accumulator accumulates the N corrected values to obtain an image value.

According to a second aspect of the present disclosure, an ultrasound receiving method including the following steps is provided. N return-wave signals corresponding to N channels are respectively stored in N sets of shift register arrays, N being a positive integer. Each set of the shift register arrays includes a delay filter unit and M shift registers, and the M shift registers are cascaded and store the corresponding return-wave signal, M being a positive integer. A delay controller is utilized to assign a set of coefficients to the delay filter unit to perform an interpolation operation on data of the M shift registers to obtain an output value. N FIFO buffers are utilized to temporarily store the N output values. The delay controller is utilized to decide delay time of each channel according to a delay table, and accordingly control a time multiplexer to switch and output the N values in order. A multiplier is utilized to multiply the output value received from the time multiplexer by a weighted value corresponding to the channel to obtain a corrected value. An accumulator is utilized to accumulate the N corrected values to obtain an image value.

According to a third aspect of the present disclosure, an ultrasound receiving system is provided. The ultrasound receiving system includes S aperture units, an ADC unit, S said ultrasound receiving modules, S FIFO buffers and an adder, S being a positive integer. Each of the S aperture units includes N aperture elements for receiving N return waves, N being a positive integer. The ADC unit converts the S×N return waves into S×N return-wave signals. S said ultrasound receiving modules, respectively corresponding to the S aperture units, obtain S image values. The S FIFO buffers temporarily store the S image values. The adder sums up the S image values.

The disclosure will become apparent from the following detailed description of the preferred but non-limiting embodiments. The following description is made with reference to the accompanying drawings.

DETAILED DESCRIPTION

The disclosure proposes an ultrasound receiving module, method and system. Each ultrasound receiving module can individually process return-wave signals of multiple channels, and a combination of the multiple ultrasound receiving modules can process more channels or more return-wave signals under a multiple line acquisition (MLA) mode.

Figure 1:
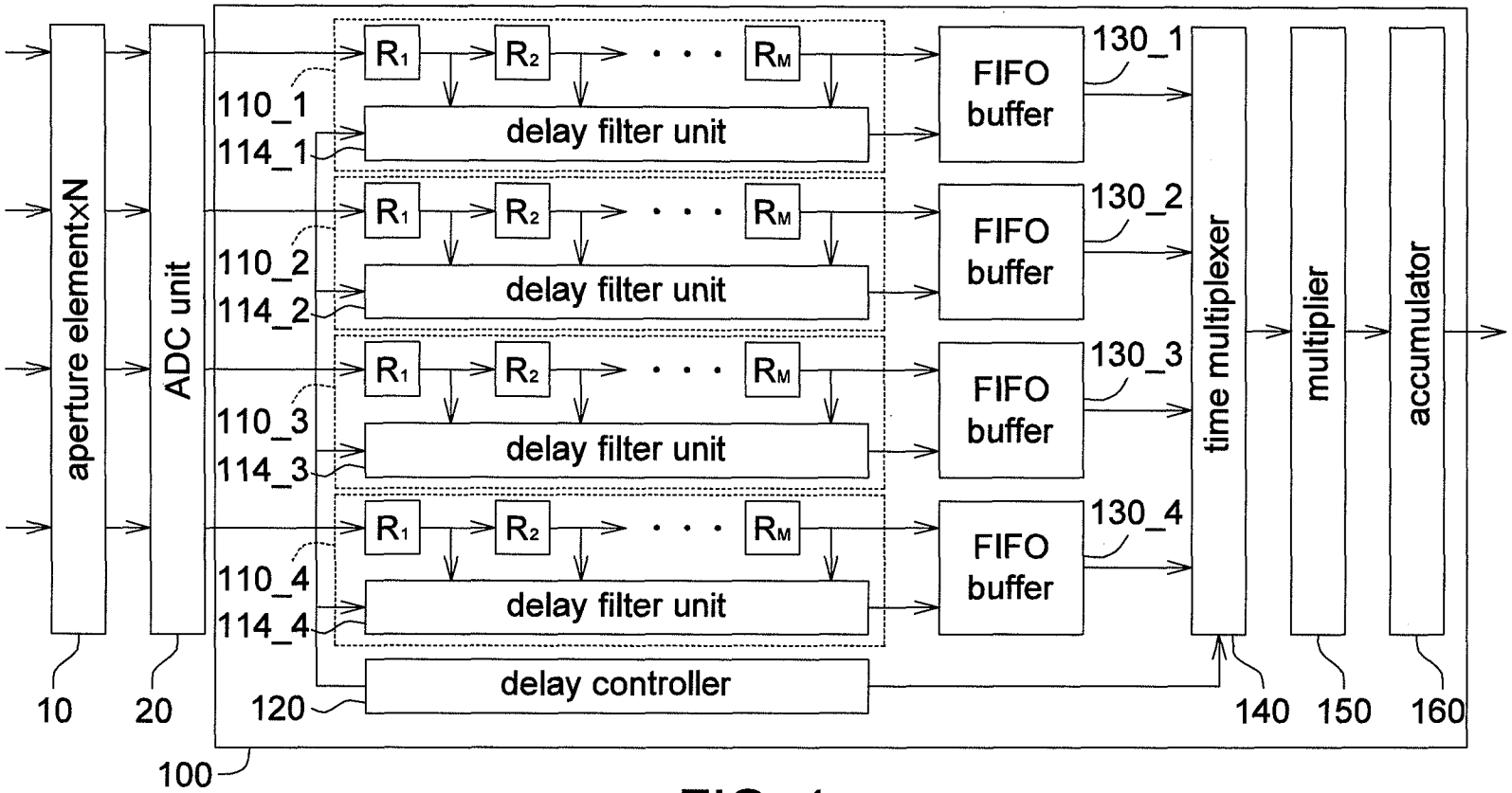
FIG. 1 shows a block diagram of an ultrasound receiving module according to an embodiment.

Referring to FIG. 1, a block diagram of an ultrasound receiving module according to an embodiment is shown. Take the positive integer, N, equal to 4 as being exemplified in FIG. 1, but it is not limited. The ultrasound receiving module 100 includes N sets of shift register arrays 110_1 to 110_4, a delay controller 120, N FIFO buffers 130_1 to 130_4, a time multiplexer 140, a multiplier 150 and an accumulator 160. In FIG. 1, N aperture elements 10 receive N return waves corresponding to N channels. An ADC unit 20 converts the N return waves into N return-wave signals corresponding to the N channels.

Each set of the shift register arrays 110_1 to 110_4 includes a delay filter unit and M cascaded shift registers $R_1$ to $R_M$. M is a positive integer and can be determined by a follow-up to-be-performed interpolation operation. The return-wave signal of each channel is stored to the corresponding shift registers $R_1$ to $R_M$ according to timing sequences. The delay controller 120 reads delay time of each channel of a to-be-restored depth point from a delay table.

And the delay controller 120 assigns a set of coefficients to the delay filter unit of each channel according to the required precision, so that an interpolation operation is performed on data of the M shift registers $R_1$ to $R_M$ to obtain an output value. The set of the coefficients includes M coefficients, each of which belongs to power of 2, such as $2^0$, $2^{-1}$, $2^{-2}$, etc.

Figure 2:
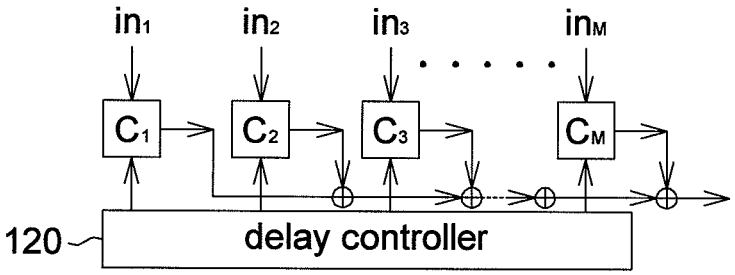
FIG. 2 shows a schematic illustration showing an interpolation operation according to an embodiment.

Referring to FIG. 2, a schematic illustration showing an interpolation operation according to an embodiment is shown. In FIG. 2, $in_1$ to $in_M$ are values of the data stored in the shift registers $R_1$ to $R_M$, and $C_1$ to $C_M$ are the coefficients assigned by the delay controller 120. In the embodiment, the coefficients $C_1$ to $C_M$ belong to power of 2 and can cooperate with a shifting operation to perform multiplication. Due to the limitation of the sampling rate of the ADC unit 20, the delay time of the sampled values is just a multiple of the sampling rate. Therefore, the delay controller 120 is needed to assign the set of the coefficients according to the delay table to perform the auxiliary interpolation operation to obtain precise time delays. When the shift registers $R_1$ to $R_M$ are filled, an output value of the interpolation operation is obtained at each clock cycle by taking advantage of parallel pipelines.

The N FIFO buffers 130_1 to 130_4 are respectively coupled to the N sets of the shift register arrays 110_1 to 110_4, and temporarily store the N output values for speed regulation. Because each channel receives the corresponding return wave at different time, the time multiplexer 140 uses the method of time multiplexing to switch and output the output values in order according to the delay time of each channel to perform an apodization operation. The multiplier 150 multiplies the output value received form the time multiplexer 140 by a weighted value corresponding to the channel to lower the side lobe effect and obtains a corrected value. The weighted value is determined by an apodization controller for example. When the operations of the weighted values of the channels are completed, the adder 160 accumulates the N corrected values to obtain an image value.

Figure 3:
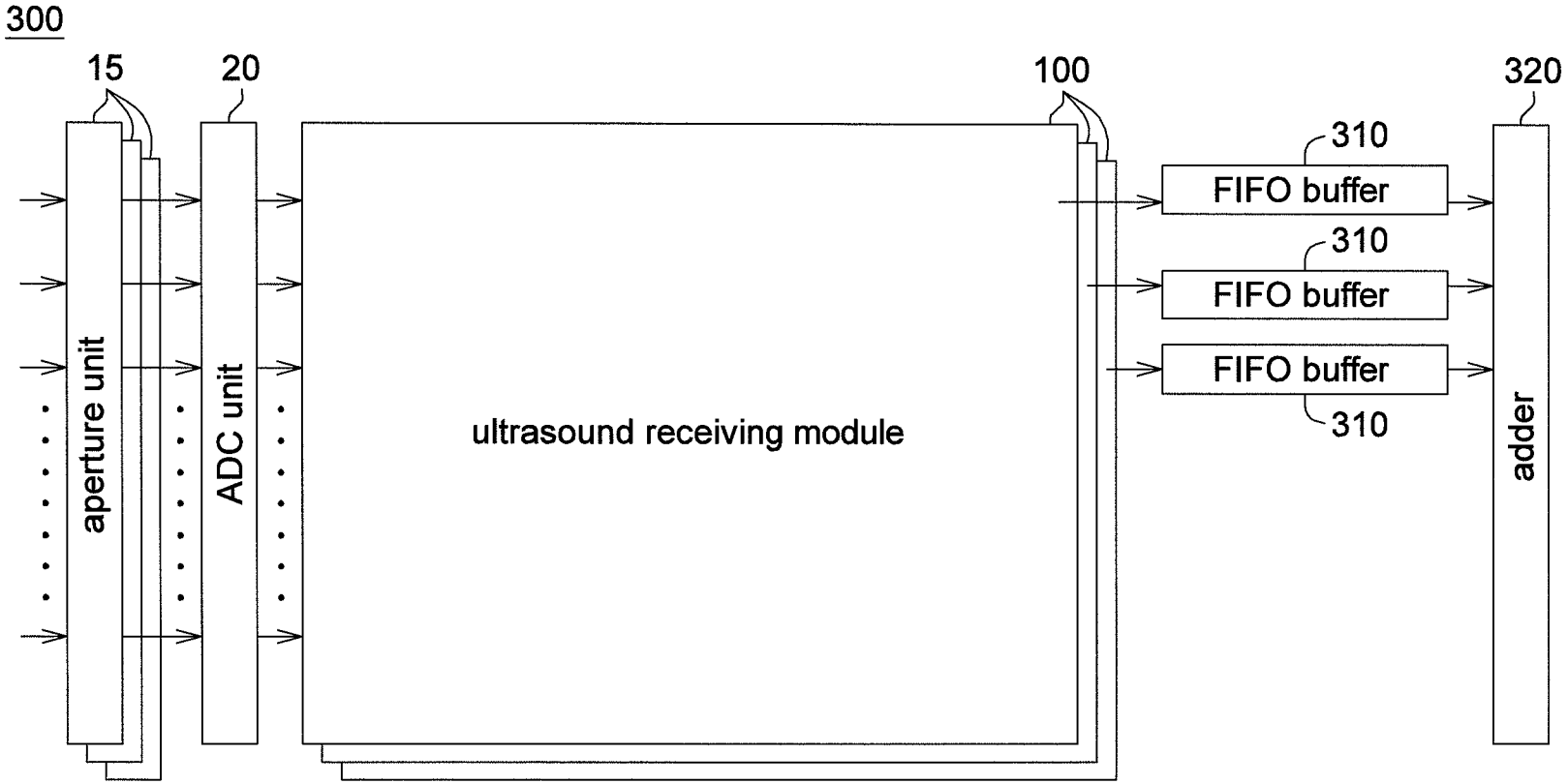
FIG. 3 shows a schematic illustration showing an ultrasound receiving system according to an embodiment.

When the channel number N of the ultrasound receiving module is less than the number of the actually used channels, multiple ultrasound receiving module may be used for beam forming. Referring to FIG. 3, a schematic illustration showing an ultrasound receiving system according to an embodiment is shown. The ultrasound receiving system 300 includes S aperture units 15, an ADC unit 20, S said ultrasound receiving modules 100, S FIFO buffers 310 and an adder 320, S being a positive integer. Each of the S aperture units 15 includes N aperture elements for receiving N return waves. The ADC unit 20 converts the S×N return waves into S×N return-wave signals. The S ultrasound receiving modules 100 respectively correspond to the S aperture units 10 and are used to obtain S image values. Due to different processing abilities of the ultrasound receiving modules, the S FIFO buffers 310 temporarily store the S image values to achieve the time consistency. Therefore, the adder 320 sums up the S image values at the same time to obtain an output beam of some depth point.

For example, assume that the ultrasound receiving system 300 corresponds to 32 channels and each of the ultrasound receiving modules 100 is capable of processing return waves of 8 channels, then only 4 sets of the ultrasound receiving modules 100 are needed to implement the beam forming function of the 32 channels. If the receiving end of the ultrasound beam former is under a 1:Y MLA mode, the expanding requirement is met by using Y sets of the ultrasound receiving modules 100 without changing hardware architecture of the ultrasound receiving module 100.

The disclosure further proposes an ultrasound receiving method, which includes the following steps. N return-wave signals corresponding to N channels are respectively stored in N sets of shift register arrays, N being a positive integer. Each set of the shift register arrays includes a delay filter unit and M shift registers, and the M shift registers are cascaded and store the corresponding return-wave signal, M being a positive integer. A delay controller is utilized to assign a set of coefficients to the delay filter unit to perform an interpolation operation on data of the M shift registers to obtain an output value. N FIFO buffers are utilized to temporarily store the N output values. The delay controller is utilized to decide delay time of each channel according to a delay table, and accordingly control a time multiplexer to switch and output the N values in order. A multiplier is utilized to multiply the output value received from the time multiplexer by a weighted value corresponding to the channel to obtain a corrected value. An accumulator is utilized to accumulate the N corrected values to obtain an image value.

The detailed principles of the ultrasound receiving method have been described in the ultrasound receiving module 100 and the related contents, so detailed description thereof will be omitted.

The disclosure proposes the ultrasound receiving module, method and system in the embodiments. Each ultrasound receiving module can individually process return-wave signals of multiple channels, and a combination of the multiple ultrasound receiving modules can process more channels or more return-wave signals under a multiple line acquisition mode. In addition, the shift register array is used to receive the return-wave signal to avoid complex read/write computing of the memory, and the interpolation operation is completed at each clock cycle by taking advantage of parallel pipelines to meet the precise delay requirement. Furthermore, time multiplexing is utilized to switch one set of the channels each time to perform the apodization operation, so that all the channels of each ultrasound receiving module only need one common post-stage multiplier, thus effectively reducing required resources.

While the disclosure has been described by way of example and in terms of a preferred embodiment, it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An ultrasound receiving module, comprising:

N sets of shift register arrays for respectively storing N return-wave signals corresponding to N channels, wherein each set of the shift register arrays includes a delay filter unit and M shift registers, and the M shift registers are cascaded and store the corresponding return-wave signal, N and M being positive integers;

a delay controller coupled to the N delay filter units for deciding delay time of each channel according to a delay table, and assigning a set of coefficients to the delay filter unit of each channel to perform an interpolation operation on data of the M shift registers to obtain an output value of each channel;

N FIFO buffers, respectively coupled to the N sets of the shift register arrays, for temporarily storing the N output values;

a time multiplexer coupled to the delay controller and the N FIFO buffers for switching and outputting the N output values in order according to the delay time of each channel;

a multiplier coupled to the time multiplexer for multiplying the output value of each channel received from the time multiplexer by a weighted value corresponding to the channel to obtain a corrected value of each channel; and an accumulator for accumulating the N corrected values corresponding to N channels to obtain an image value.

2. The ultrasound receiving module according to claim 1, wherein N return waves passing through N aperture elements are converted by an ADC unit into the N return-wave signals.

3. The ultrasound receiving module according to claim 1, wherein the set of the coefficients includes M coefficients, each of which equals to $2^n$, and n is an integer.

4. An ultrasound receiving system, comprising:

S aperture units, each of which includes N aperture elements for receiving N return waves, S and N being positive integers, S is a positive integer greater than 1;

an ADC unit for converting the S×N return waves into S×N return-wave signals;

S said ultrasound receiving modules in claim 1, respectively corresponding to the S aperture units, for obtaining S image values;

S FIFO buffers for temporarily storing the S image values; and an adder for summing up the S image values.

5. The ultrasound receiving system according to claim 4, wherein the set of the coefficients includes M coefficients, each of which equals to $2^n$, and n is an integer.

6. An ultrasound receiving method, comprising:

respectively storing N return-wave signals corresponding to N channels in N sets of shift register arrays, wherein each set of the shift register arrays includes a delay filter unit and M shift registers, and the M shift registers are cascaded and store the corresponding return-wave signal, N and M being positive integers;

utilizing a delay controller coupled to the N delay filter units to assign a set of coefficients to the delay filter unit of each channel to perform an interpolation operation on data of the M shift registers to obtain an output value of each channel;

utilizing N FIFO buffers to temporarily store the N output values;

utilizing the delay controller to decide delay time of each channel according to a delay table, and accordingly control a time multiplexer coupled to the delay controller and the N FIFO buffers to switch and output the N output values of N channels in order;

utilizing a multiplier coupled to the time multiplexer to multiply the output value of each channel received from the time multiplexer by a weighted value corresponding to the channel to obtain a corrected value of each channel; and utilizing an accumulator to accumulate the N corrected values corresponding to N channels to obtain an image value.

7. The ultrasound receiving method according to claim 6, further comprising:

utilizing an ADC converter to convert N return waves passing through N aperture elements into the N return-wave signals.

8. The ultrasound receiving method according to claim 6, wherein the set of the coefficients includes M coefficients, each of which equals to $2^n$, and n is an integer.

* * * * *